US011534001B2

(12) United States Patent
Golfari

(10) Patent No.: US 11,534,001 B2
(45) Date of Patent: Dec. 27, 2022

(54) FOLDABLE ARTICULATED STRUCTURE, PARTICULARLY FOR SUPPORTING A SEAT OR BEARING SURFACE

(71) Applicants: Nicola Golfari, Milan (IT); Alessandro Belloni, Milan (IT)

(72) Inventor: Nicola Golfari, Milan (IT)

(73) Assignees: Nicola Golfari, Milan (IT); Alessandro Belloni, Milan (IT)

( * ) Notice: Subject to any disclaimer, the term of this patent is extended or adjusted under 35 U.S.C. 154(b) by 332 days.

(21) Appl. No.: 16/607,858

(22) PCT Filed: Apr. 26, 2018

(86) PCT No.: PCT/IB2018/052892

§ 371 (c)(1),
(2) Date: Oct. 24, 2019

(87) PCT Pub. No.: WO2018/198059

PCT Pub. Date: Nov. 1, 2018

(65) Prior Publication Data

US 2020/0187661 A1 Jun. 18, 2020

(30) Foreign Application Priority Data

Apr. 27, 2017 (IT) ..... 102017000045536

(51) Int. Cl.
*A47C 9/06* (2006.01)
*A47B 5/04* (2006.01)

(52) U.S. Cl.
CPC . *A47C 9/06* (2013.01); *A47B 5/04* (2013.01)

(58) Field of Classification Search
CPC .... A47C 9/06; A47B 5/04; A47B 5/00; A47B 5/006; A47B 96/027; A47B 96/06; A47B 96/061
USPC ..... 297/59, 14; 248/240, 240.2, 241–246
See application file for complete search history.

(56) References Cited

U.S. PATENT DOCUMENTS 272,522 A * 2/1883 Briggs ..... A47C 9/06 248/240.1
1,133,611 A * 3/1915 Borgmeyer ..... B60R 7/02 211/12
1,509,863 A * 9/1924 Erickson ..... A47C 7/56 248/240.4

(Continued)

FOREIGN PATENT DOCUMENTS

EP 0320199 A1 * 6/1989
GB 328810 A 5/1930

*Primary Examiner* — Eret C McNichols
(74) *Attorney, Agent, or Firm* — Maschoff Brennan

(57) ABSTRACT

A foldable articulated structure for supporting a seat or a bearing surface includes a first bracket which can be fastened to a wall and a second bracket which can be associated with a seat or a bearing surface. A first arm has a first end hinged to a first portion of the first bracket and a second end hinged to a first portion of the second bracket. A second arm has a first end hinged to a second portion of the first bracket and a second end hinged to a second portion of the second bracket. The foldable articulated structure is movable from a closed configuration in which the second bracket lies on a plane substantially parallel to the plane of the wall, to an open configuration in which the second bracket lies on a plane substantially orthogonal to the plane of the wall.

9 Claims, 8 Drawing Sheets

(56) References Cited

U.S. PATENT DOCUMENTS 1,515,242 A * 11/1924 Dexter ..... A47B 5/04 108/134
1,658,771 A * 2/1928 Nelson ..... A47B 5/04 108/38
1,677,620 A * 7/1928 Cummings ..... A47B 5/04 108/38
1,753,423 A * 4/1930 Kroschel ..... A47B 5/04 108/37
1,842,954 A * 1/1932 Anderson ..... A47B 5/04 248/240
1,937,386 A * 11/1933 Howe ..... A47B 5/04 108/167
2,199,981 A * 5/1940 Bell ..... A47B 5/04 108/38
2,239,225 A * 4/1941 Gordon ..... A47B 5/04 108/134
2,298,002 A * 10/1942 Fay ..... D06F 81/06 38/104
2,716,044 A * 8/1955 Overby ..... A47B 5/04 108/166
2,943,896 A * 7/1960 Gaston ..... A47B 5/04 108/134
3,451,360 A * 6/1969 Lemoyne ..... A47B 5/04 108/34
3,696,762 A * 10/1972 Holdham ..... A47B 5/04 108/134
3,730,107 A * 5/1973 Bergkamp ..... A47B 5/04 108/39
4,100,858 A * 7/1978 Bue ..... A47B 5/04 108/48
4,276,955 A * 7/1981 Hickman ..... E06C 1/005 182/33
4,480,556 A 11/1984 Wilson et al.
4,639,037 A * 1/1987 Maruyama ..... A47C 9/06 248/240.4
4,927,107 A * 5/1990 Mateo Maria ..... A47B 5/04 248/240.4
5,240,215 A * 8/1993 Moore ..... A47B 5/04 108/10
6,343,834 B1 * 2/2002 Wurmlinger ..... A47C 9/06 108/134
6,527,341 B1 * 3/2003 Martin ..... A47C 1/12 248/240.4
6,705,235 B1 * 3/2004 Gerutto ..... A47B 5/00 108/47
6,974,184 B1 * 12/2005 Moffa ..... B60N 2/3011 297/14
7,210,414 B1 * 5/2007 Barone ..... A47B 23/04 108/42
8,109,563 B2 * 2/2012 Hansen ..... B64D 25/04 297/14
8,267,017 B1 * 9/2012 Michael ..... A47B 5/04 108/42
9,414,670 B2 * 8/2016 Bo ..... A47B 3/002
2003/0188672 A1 * 10/2003 Parent ..... A47B 5/006 108/134

* cited by examiner

FOLDABLE ARTICULATED STRUCTURE, PARTICULARLY FOR SUPPORTING A SEAT OR BEARING SURFACE

The present invention relates to a foldable articulated structure, and more specifically a four-bar linkage, particularly for supporting a seat or a bearing surface.

Articulated structures defined by four-bar linkages actually are implemented, in the diversified shapes they may take on, in the most varied of technical fields, such as kinematic mechanisms for moving for example, gates, doors, shutters, tilting elements and drop-leaf tables.

A problem common to such articulated structures of known type relates to the way in which the locking of the structure itself is ensured in the operating positions—the open or closed positions—such as for example, in the case of a tilting element for a garage or a drop-leaf table.

Indeed, especially in the case of movable elements that open and close by contrasting the force of gravity, it is necessary to ensure that such elements stably remain in the open position or in the closed position.

The main task of the present invention consists in making a foldable articulated structure, particularly for supporting a seat or a bearing surface, that solves the technical problem set forth above, and in particular that is capable of stably remaining in the open position and in the closed position.

An object of the present invention within the scope of this task is the one of making a foldable articulated structure, the locking of which in the open and closed position may be obtained in a very simple manner, without resorting to complicated technical solutions or costly motorized solutions.

Another object of the invention consists in making a foldable articulated structure that automatically locks in the open position and in the closed position.

Another object of the invention consists in making a foldable articulated structure that has reduced sizes and weights and is particularly suitable for supporting wall-mounted seats.

A further object of the invention consists in making a foldable articulated structure that is capable of providing the most ample guarantees of reliability and safety in use.

Another object of the invention consists in making a foldable articulated structure that is easy to make and is economically competitive when compared with the known technique.

The task set forth above and the objects indicated, and others which will be more apparent below, are achieved by a foldable articulated structure, particularly for supporting a seat or a bearing surface, according to that indicated in claim 1.

Further features are provided in the dependent claims.

Other features and advantages shall be apparent from the description of a preferred, but not exclusive, embodiment of a foldable articulated structure, particularly for supporting a seat or a bearing surface, illustrated by mere way of non-limiting example with the aid of the accompanying drawings, in which.

Figure 2:
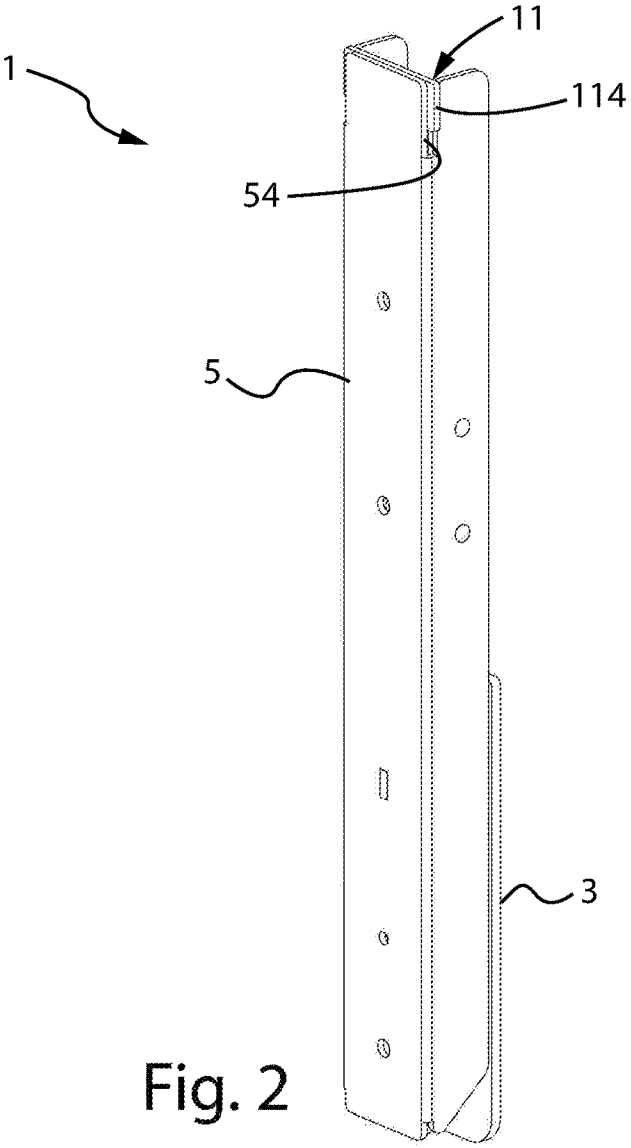
FIG. 2 is an axonometric view of the foldable articulated structure, according to the invention, illustrated in closed configuration.
Figure 1:
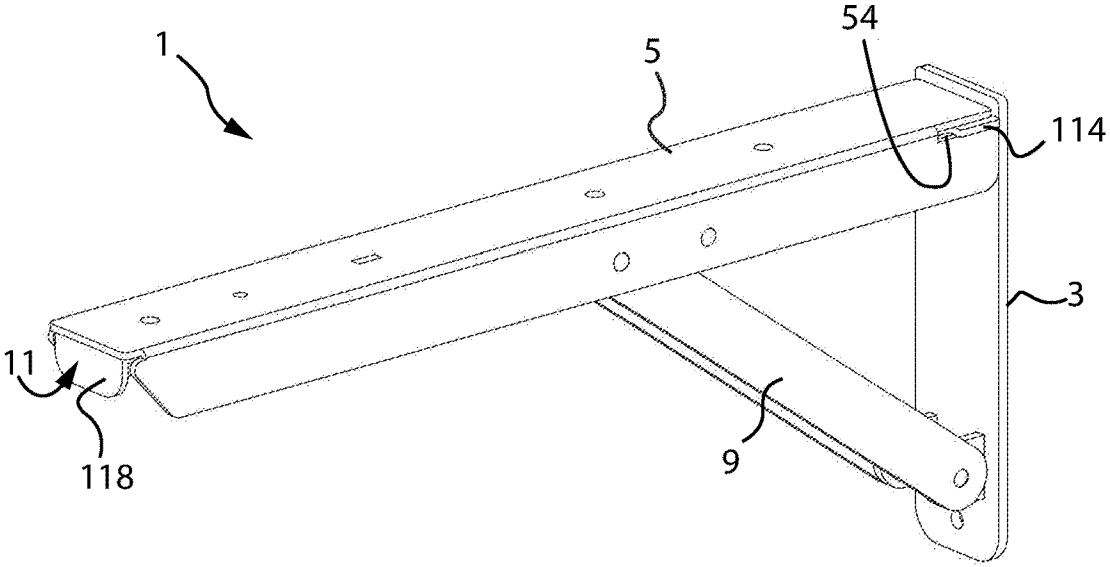
FIG. 1 is an axonometric view of one embodiment of a foldable articulated structure, according to the invention, illustrated in open configuration.

With reference to the drawings mentioned, the foldable articulated structure, particularly for supporting a seat or a bearing surface, indicated as a whole with reference numeral 1, comprises a first bracket 3 which can be fastened to a wall, a second bracket 5 which can be associated with a seat or a bearing surface, a first arm 7 and a second arm 9.

A first end 70 of the first arm 7 is hinged to a first portion 30 of the first bracket 3.

A second end 71 of the first arm 7 is hinged to a first portion 50 of the second bracket 5.

A first end 90 of the second arm 9 is hinged to a second portion 31 of the first bracket 3.

A second end 91 of the second arm 9 is hinged to a second portion 51 of the second bracket 5.

The foldable articulated structure 1 is movable from a closed configuration in which the second bracket 5 lies on a plane substantially parallel to the plane of the wall, to an open configuration in which the second bracket 5 lies on a plane substantially orthogonal to the plane of the wall.

According to the invention, the second bracket 5 comprises a slider 11 which is slidable with respect to such second bracket 5. The slider 11 comprises first hooking means 13 which actuate for locking the foldable articulated structure 1 in the open configuration and second hooking means 15 which actuate for locking the foldable articulated structure 1 in the closed configuration.

Advantageously, the second bracket 5 may be associated with a seat 19 or a table. In both cases, the open configuration of the foldable articulated structure 1 coincides with the use configuration of the seat 19 as seat plane or of the table as bearing surface, while the closed configuration of the foldable articulated structure 1 coincides with the rest configuration of the seat 19 or of the table.

Advantageously, the second bracket 5 may be associated with a support bar. The open configuration of the foldable articulated structure 1 coincides with the use configuration of the support bar, which acts as bearing point for an older user or a user with motor disabilities. Thereby, a support bar, or aid bar, of the folding type is obtained.

Moreover, in addition to support of a seat or a bearing surface, the articulated structure examined—adequately sized—advantageously is suitable for being used for all the support structures in which it is useful to quickly and accurately pass from a compact linear configuration to an open orthogonal configuration.

Advantageously, the first hooking means 13 comprise a first hook 130 configured for being hooked, in the open configuration of the foldable articulated structure 1, to a fastening pin 10.

Advantageously, the second hooking means 15 comprise a second hook 150 configured for being hooked, in the closed configuration of the foldable articulated structure 1, to a fastening pin 10.

Preferably, as illustrated in the embodiment of the foldable articulated structure 1 presented in the accompanying drawings, the first hook 130 and the second hook 150 are configured for being hooked, in the open configuration and in the closed configuration, respectively, of the foldable articulated structure 1, to a same fastening pin 10.

Advantageously, the fastening pin 10 may be arranged on the first arm 7.

Advantageously, the first fastening means 130 may comprise a pair of adjacent hooks 130, 130'.

Advantageously, the second fastening means 150 may comprise a pair of adjacent hooks 150, 150'.

The foldable articulated structure 1 comprises pulling elastic means 17 interposed between the second bracket 5 and the slider 11, configured for holding the first hook 130 engaged with the fastening pin 10 in the open configuration of the foldable articulated structure 1, and for holding the second hook 150 engaged with the fastening pin 10 in the closed configuration of the foldable articulated structure 1.

The elastic means 17 advantageously comprise a spring 170, a first end 171 of which is fastened to a first flap 110 integral with the slider 11 and protruding therefrom, and a second end 172 of which is associated with a second flap 53 integral with the second bracket 5 and protruding therefrom. The slider 11 comprises a window 112 extending in a longitudinal direction crossed by such second flap 53 and sized so as to allow the relative movement between the slider 11 and the second bracket 5.

Advantageously, as better illustrated in FIGS. 17 to 20, in the foldable articulated structure 1:

- the axes for hinging the first bracket 3 to the first arm 7 and to the second arm 9, respectively, define a first interaxle spacing 101;
- the axes for hinging the second bracket 5 to the first arm 7 and to the second arm 9, respectively, define a second interaxle spacing 102;
- the axes for hinging the first arm 7 to the first bracket 3 and to the second bracket 5, respectively, define a third interaxle spacing 103;
- the axes for hinging the second arm 9 to the first bracket 3 and to the second bracket 5, respectively, define a fourth interaxle spacing 104.

Preferably, the sum of the lengths of the first interaxle spacing 101 and the third interaxle spacing 103 is equal to the sum of the lengths of the second interaxle spacing 102 and of the fourth interaxle spacing 104.

Advantageously, the first bracket 3, the second bracket 5, the first arm 7 and the second arm 9 define, in the respective hinging points, a four-bar linkage, and in particular a four-bar linkage whose sides are arranged along a line in the closed configuration. Indeed, the sum of the longest interaxle spacing and of the shortest interaxle spacing equals the sum of the two interaxle spacings of intermediate length.

The four-bar linkage advantageously is configured in the open configuration, or use configuration, like a right triangle fixed to the wall by means of the first bracket 3.

Figure 20:
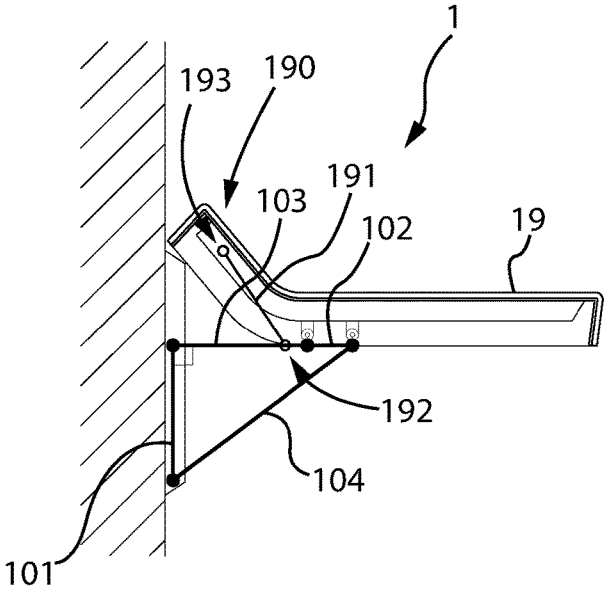

As illustrated diagrammatically in FIG. 20, in this position the second bracket 5 and the first arm 7 are aligned and form one of the cathetuses of the right triangle formed by the first bracket 3 (cathetus), by the second arm 9 (hypotenuse) and by the union of the second bracket 5 and of the first arm 7 (cathetus).

Figure 3:
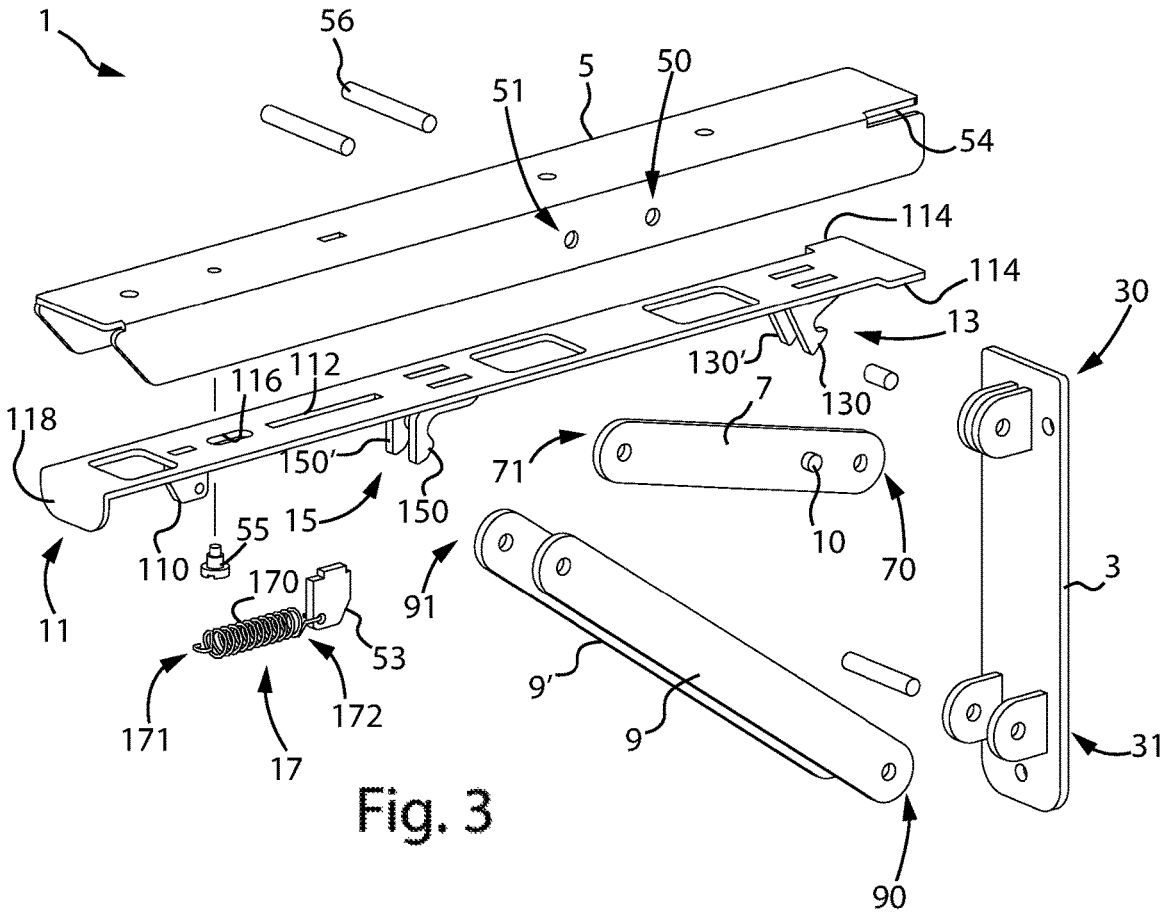
FIG. 3 is an exploded axonometric view of the foldable articulated structure of FIG. 1, according to the invention.

Advantageously, the first arm 7 and the second arm 9 may comprise one or more elements extending in a longitudinal direction, based on the loads they are to support. For example, with reference to FIG. 3, the first arm 7 is defined by a single element extending in a longitudinal direction, while the second arm 9 is defined by a pair of elements extending in a longitudinal direction 9, 9'. Advantageously, in the closed configuration of the foldable articulated structure 1, the first arm 7 is received between the two elements extending in a longitudinal direction 9, 9' that define the second arm 9.

Advantageously, the second bracket 5 has an upside-down U cross section. Thereby, the slider 11 may be slidably housed at the bottom and within the second bracket 5. The slider 11 indeed may be a plate extending in a longitudinal direction housed in the recess defined by the second bracket 5.

Advantageously, the slider 11 may comprise a pair of wings 114 laterally protruding and sliding inside corresponding slits 54 obtained in the second bracket 5. Moreover, the slider 11 may comprise a slot 116 crossed by a pin 55 protruding at the bottom from the second bracket 5. The couplings between the wings 114 and the slits 54 on one side, and between the slot 116 and the pin 55 on the other, allow the relative movement between the second bracket 5 and the slider 11 in the main axial direction.

Figure 10:
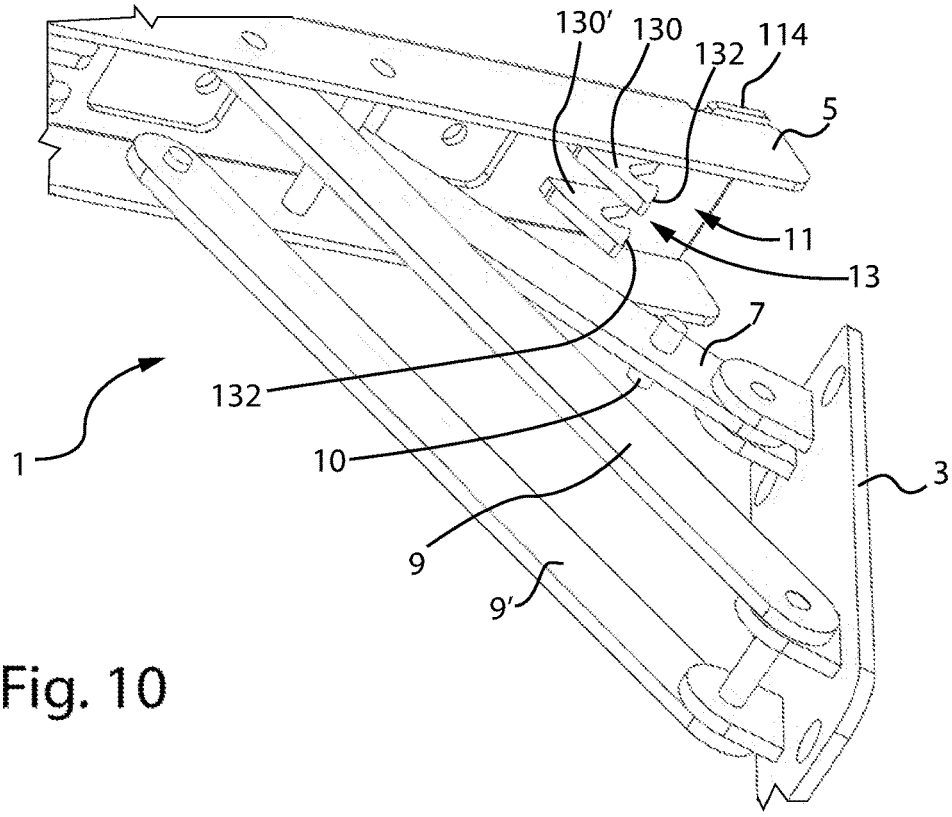
FIGS. 10 to 12 are bottom axonometric views of the foldable articulated structure of FIG. 1, according to the invention, which in particular illustrate the locking steps in the open configuration.
Figure 11:
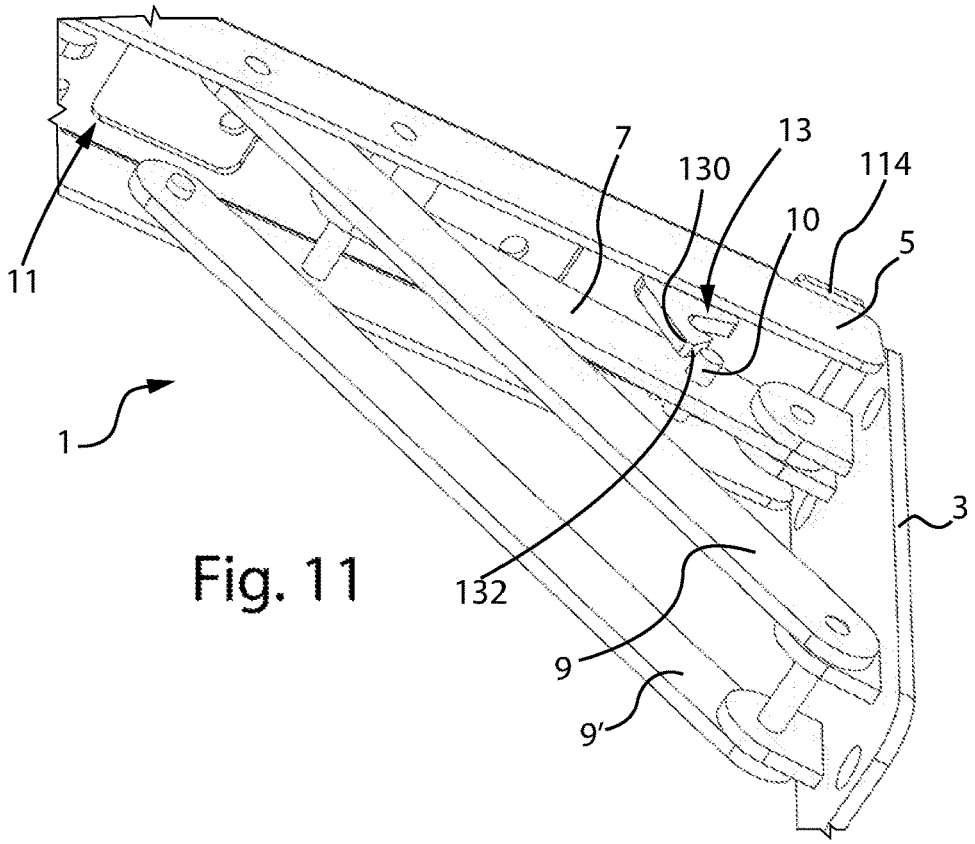
Figure 12:
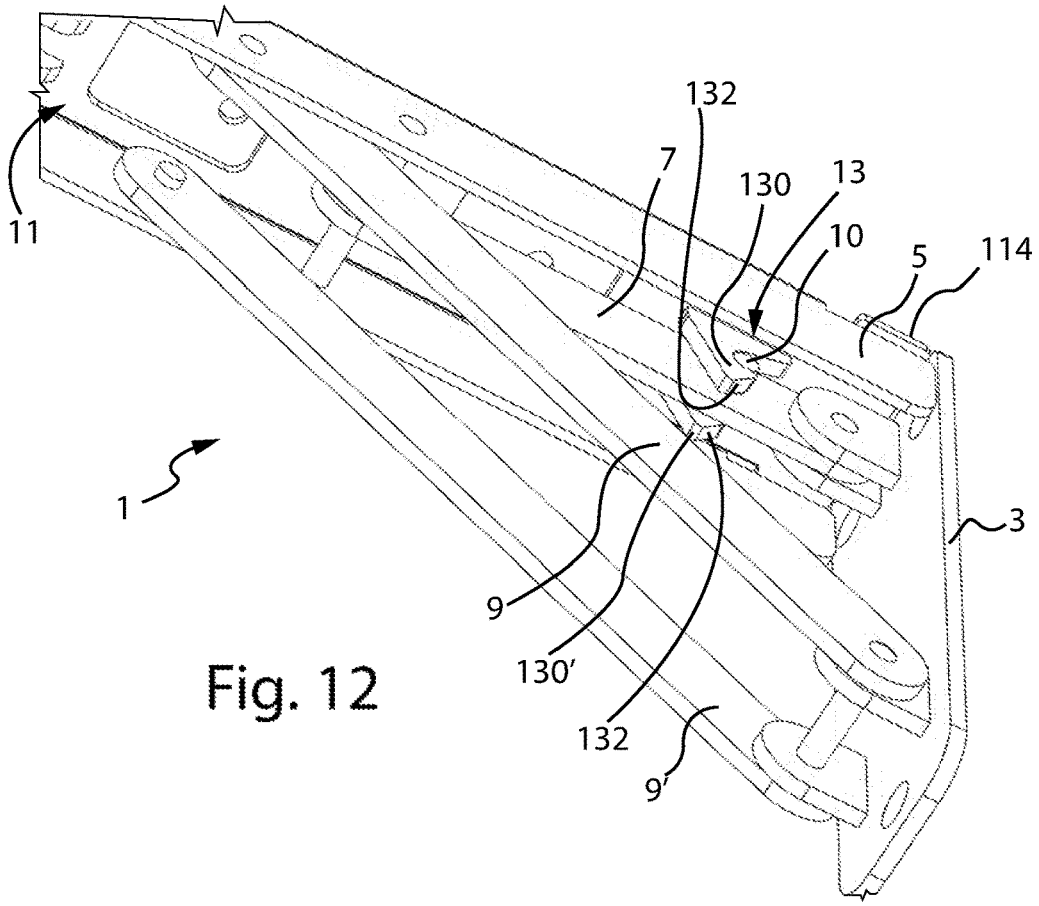

Advantageously, as illustrated in particular in FIGS. 10, 11 and 12, the first hooks 130 and 130' may have a tilted or curved introduction surface 132 which, coming in contact with the pin 10, results in the movement of the slider 11 opposing the pulling force caused by the elastic means 17 up to the point in which the pin 10 is received inside the hooks 130, 130', therefore allowing the foldable articulated structure 1 to be locked in the open configuration.

Figure 15:
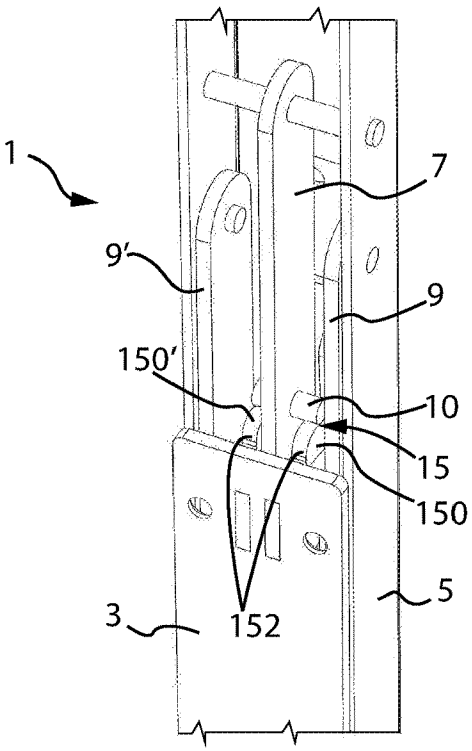
FIGS. 13 to 15 are axonometric views from behind of the foldable articulated structure of FIG. 1, according to the invention, which in particular illustrate the locking steps in the closed configuration.
Figure 14:
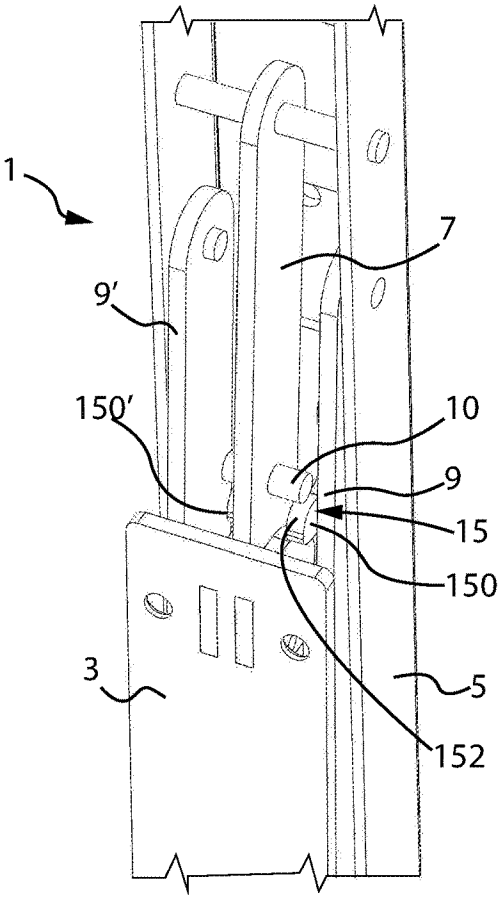
Figure 13:
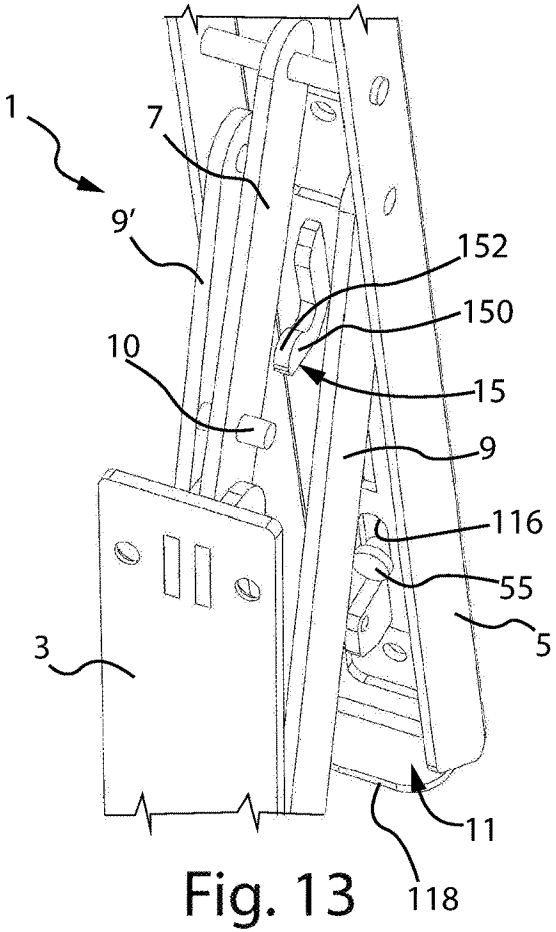
Figure 16:
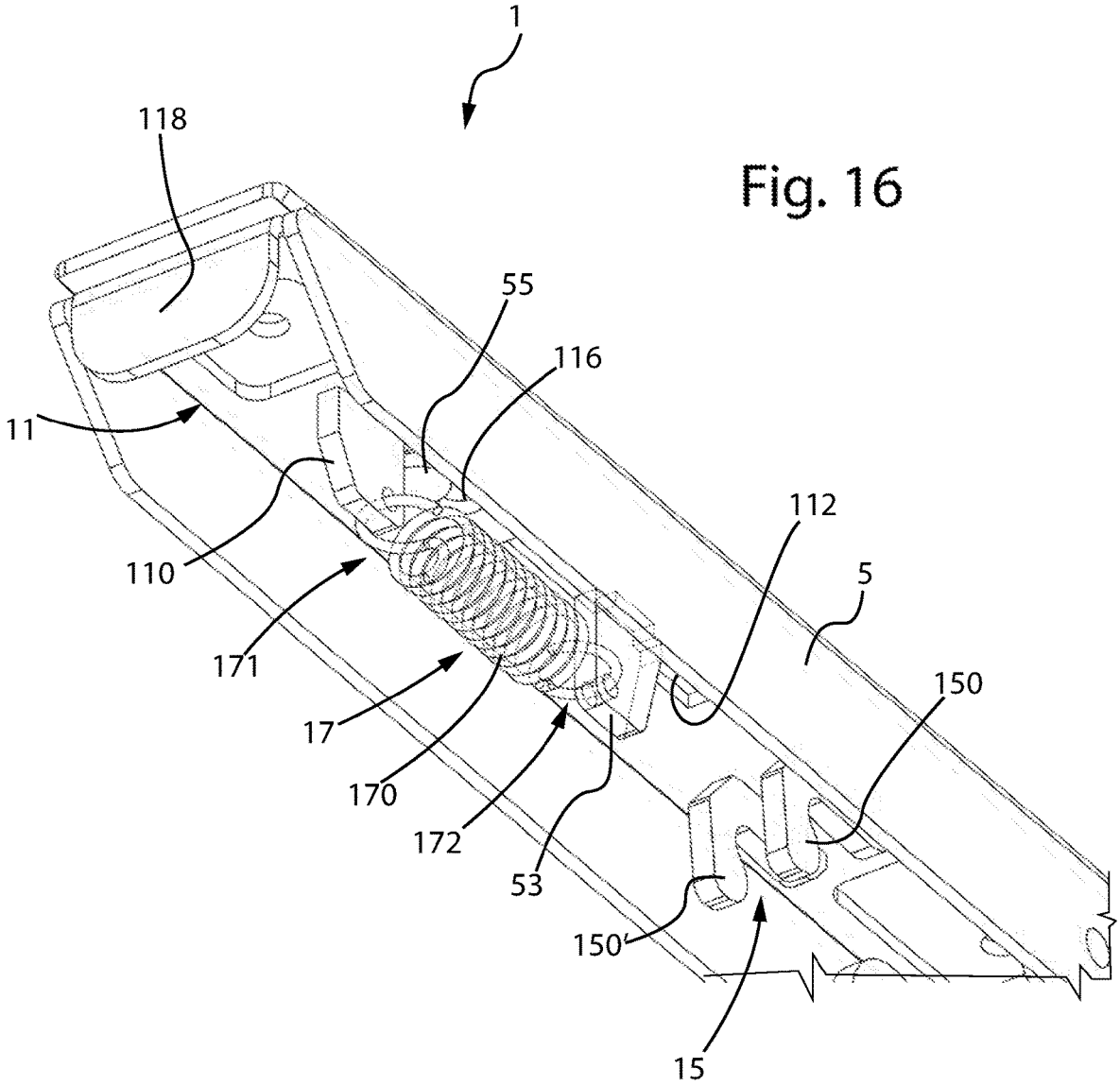
FIG. 16 is a detailed axonometric view from below of the foldable articulated structure, according to the invention.
Figure 17:
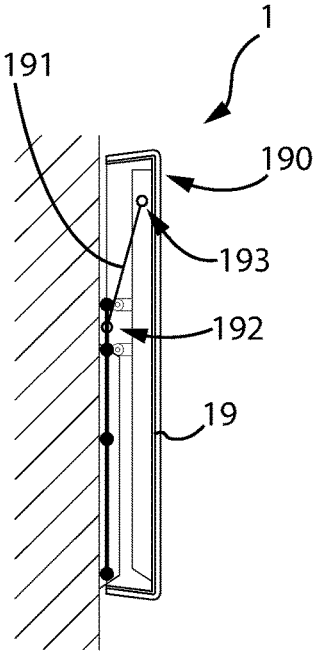
FIGS. 17 to 20 are side diagrammatic views of a variant of the foldable articulated structure, according to the invention, which illustrate the steps of passing from the closed configuration to the open configuration of the articulated structure itself.
Figure 18:
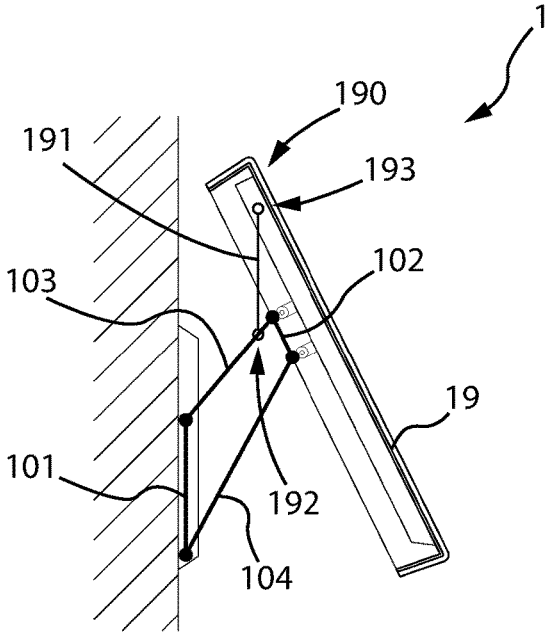
Figure 19:
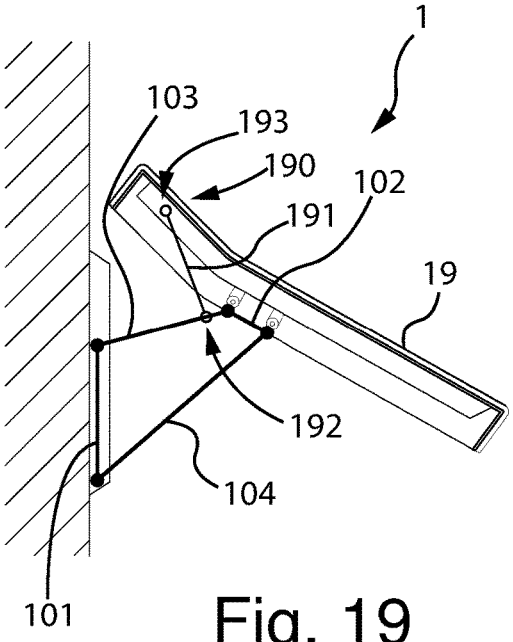

Moreover, as illustrated in particular in FIGS. 13, 14 and 15, the second hooks 150 and 150' advantageously may have a tilted or curved introduction surface 152 which, coming in contact with the pin 10, results in the movement of the slider 11 opposing the pulling force caused by the elastic means 17 up to the point in which the pin 10 is received inside the hooks 150, 150', therefore allowing the foldable articulated structure 1 to be locked in the closed configuration.

Advantageously, the slider 11 comprises a gripping portion 118 which can be gripped by a user, which may be pulled to move the slider 11 with respect to the second bracket 5, to oppose the pulling force cause by the elastic means 17 in order to free the pin 10 from the first hooking means 13 in the open configuration of the structure 1.

The gripping portion 118 may also be used to move the slider 11 with respect to the second bracket 5, to oppose the pulling force caused by the elastic means 17 in order to free the pin 10 also from the second hooking means 15 in the closed configuration of the foldable articulated structure 1.

However, given that the gripping portion 118 may not be easy to reach in the closed configuration of the foldable articulated structure 1, the release of the second hooking means 15 with respect to the pin 10 preferably is obtained simply by pulling outwards the second bracket 5, or the seat 19 associated therewith. Indeed in this case, the particular curved profile of the introduction surface 152 of the second hooks 150, 150' allows the pin 10 to slide along such surface. Therefore in essence, due to such curved introduction surface 152, the user may exert an adequate force on the second bracket 5 to allow the pulling force exerted by the elastic means 17 to be overcome, thus accordingly freeing the pin 10 from the second hooking system 15.

Thereby, due to the shape of the hooks 130, 130', 150 and 150', the automatic locking of the foldable articulated structure 1 is ensured in the open configuration and in the closed configuration, and the releasing may occur only by means of the manual intervention of the user, for example by pulling the gripping portion 118 when the structure 1 is in open configuration, or lifting the second bracket 5, or the seat 19 associated therewith, when the structure 1 is in closed configuration.

Advantageously, as illustrated in particular in the variant of the foldable articulated structure 1 presented in FIGS. 17 to 20, a seat 19 comprising a foldable portion 190 is associated with the second bracket 5. The foldable articulated structure 1 comprises a retaining lever 191 that is hinged, at a first end 192 thereof, to the first arm 7 and, at a second end 193 thereof, to such foldable portion 190 of the seat 19. In the open configuration of the foldable articulated structure 1, the retaining lever 191 forces the lifting of the foldable portion 190 of the seat 19 with respect to the seat plane.

Thereby, in the open configuration, the foldable portion 190 of the seat 19 becomes a small backrest particularly suited for the lumbar support of a person sitting on the seat 19, while in the closed configuration, the seat 19 remains completely adhering to the wall.

The foldable portion 190 of the seat 19 may comprise therein a rigid structure hinged to the inner rigid structure of the remaining part of the seat 19. Alternatively, the foldable portion 190 may be an elastically deformable portion of the seat 19 itself.

The operation of the foldable articulated structure 1 is described below, with particular reference to the accompanying drawings.

Figure 4:
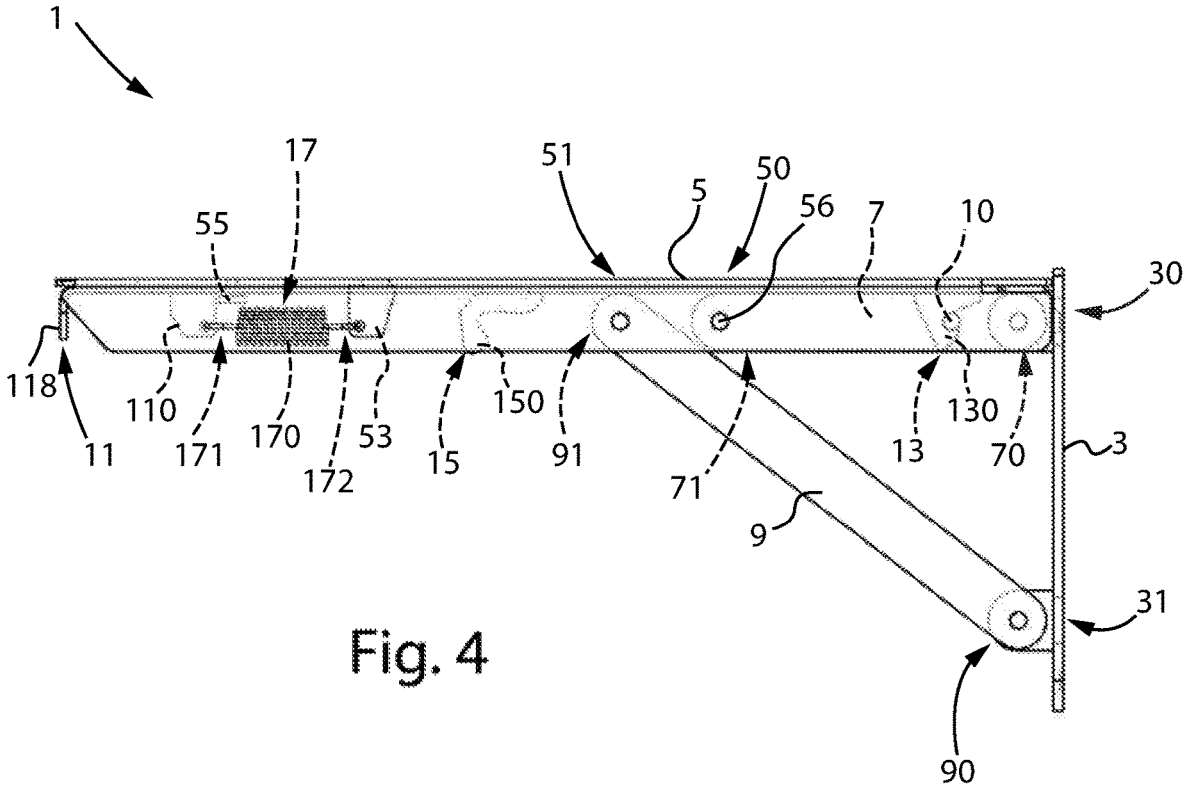
FIGS. 4 to 8 are side views of the foldable articulated structure of FIG. 1, according to the invention, which illustrate the steps of passing from the open configuration of FIG. 1 to the closed configuration of FIG. 2.

FIG. 4 illustrates the open configuration of the foldable articulated structure 1. The first hook 130 is engaged with the pin 10 and such engagement is kept due to the effect of the elastic means 17, which push the slider 11, and therefore the hook 130 against the pin 10.

The pin 10 is fixed to the first arm 7, which is hinged to the second bracket 5 by means of the pin 56. Therefore, in the open configuration, the pin 10 in fact is integral with the second bracket 5.

In order to fold the foldable articulated structure 1, there is a need to move the slider 11 with respect to the second bracket 5, for example manually gripping the gripping portion 118, to oppose the pulling force exerted by the elastic means 17 to the point of freeing the hook 130 from the engagement with the pin 10.

Figure 5:
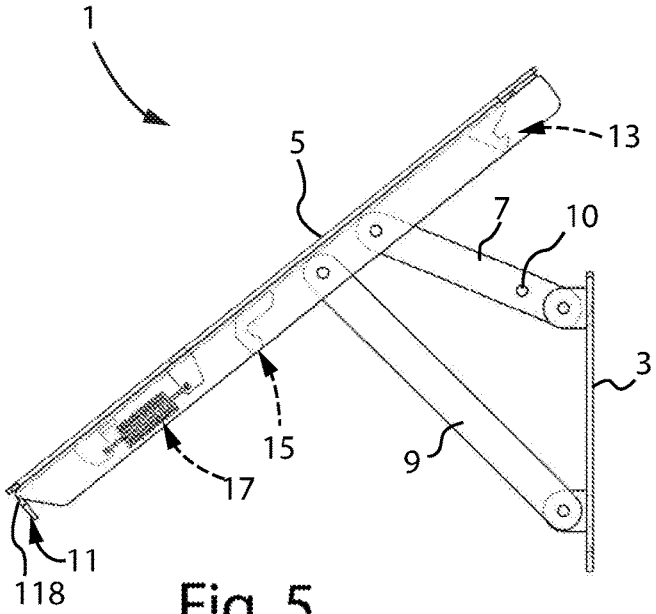
Figure 6:
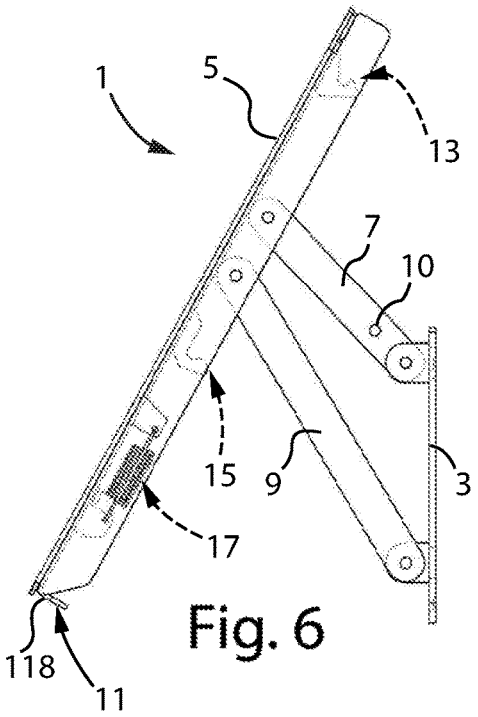
Figure 7:
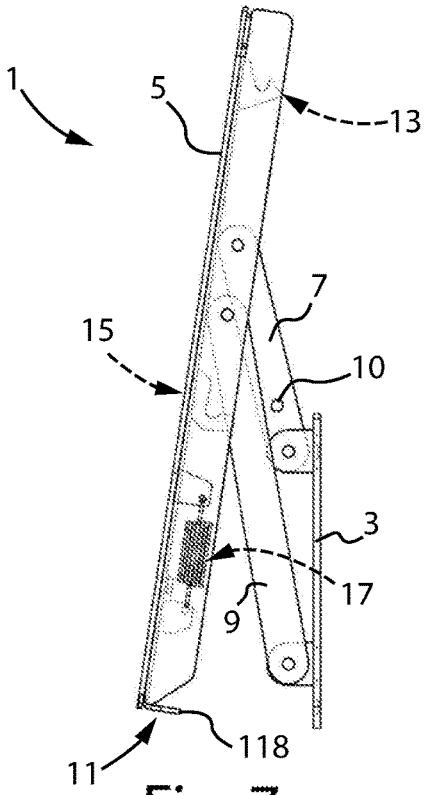
Figure 8:
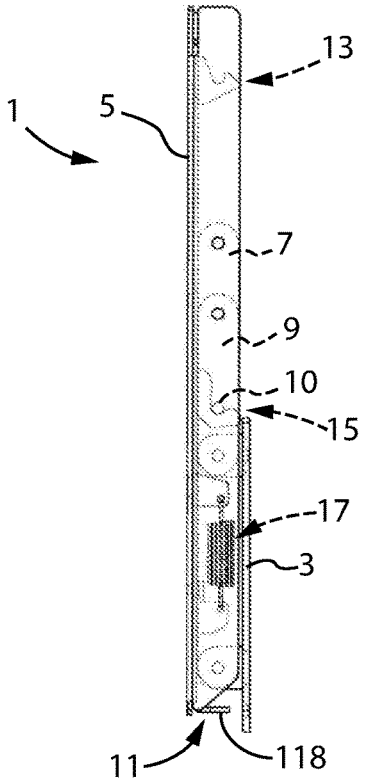
Figure 9:
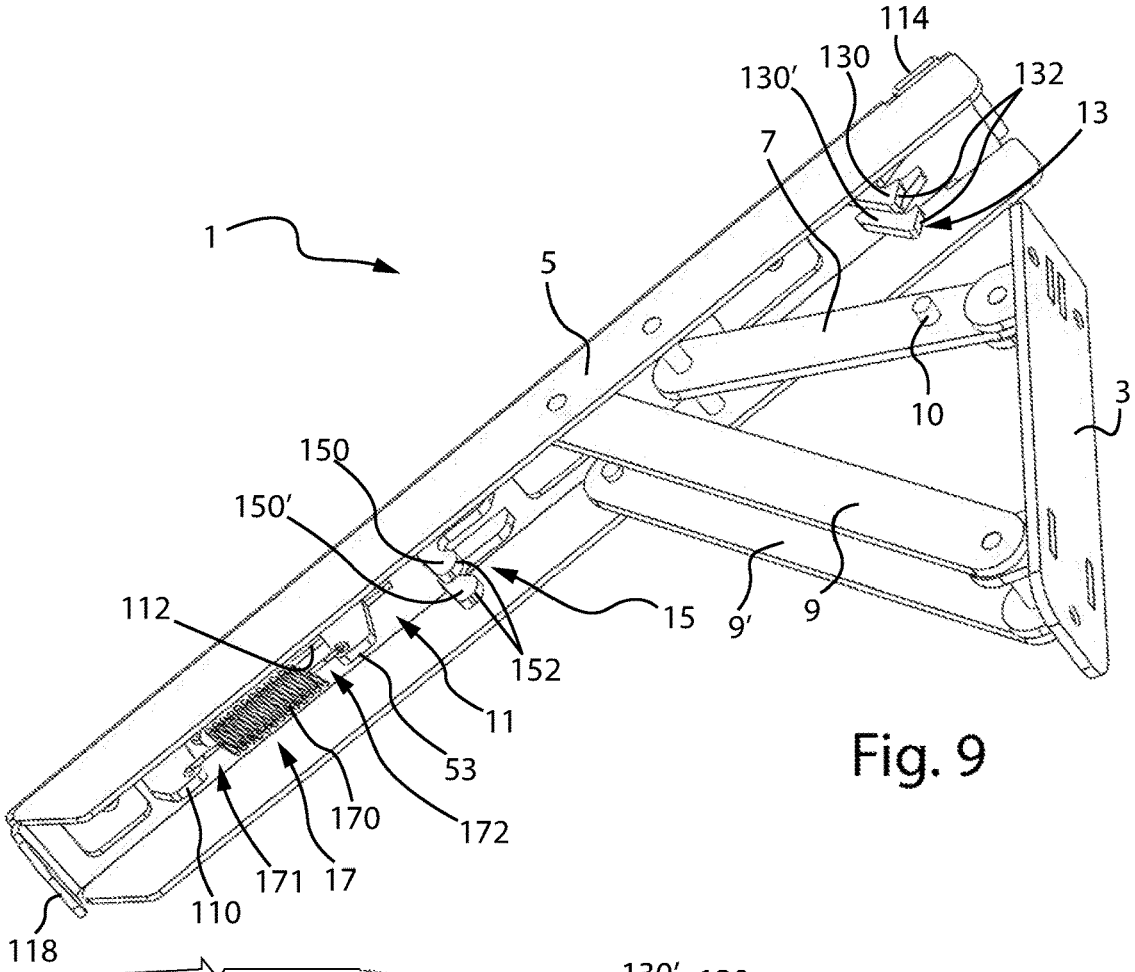
FIG. 9 is a bottom axonometric view of the foldable articulated structure of FIG. 1, according to the invention.

FIGS. 5 to 7 illustrate certain folding steps of the foldable articulated structure 1, up to reaching the closed configuration, illustrated in FIG. 8.

The pin 10 faces the second hook 150 in the closed configuration. In order for the pin 10 to be inserted into the hook 150, there is a need for a relative movement of the slider 11 with respect to the second bracket 5, to oppose the pulling force exerted by the elastic means 17, which movement is caused by the curved introduction surface 152 of the hook 150, which slides on the pin 10.

Similarly to what occurs in the open configuration, the pin 10 is stably engaged with the hook 150 also in the closed configuration due to the effect of the pulling of the elastic means 17.

The releasing of the closed configuration also may occur by manually pulling the gripping portion 118 of the slider 11 and freeing the second hooks 150 and 150' from the pin 10, or preferably lifting outwards the second bracket 5 or the seat 19 or the bearing surface associated therewith.

The locking of the foldable articulated structure 1 in the open configuration occurs when the pin 10 is inserted into the first hook 130. In order for this to occur automatically, the hook 130 faces its introduction surface 132 tilted to the pin 10, resulting in an axial movement of the slider 11 with respect to the second bracket 5, thus opposing the pulling force exerted by the elastic means 17.

The foldable articulated structure, particularly for supporting a seat or a bearing surface, the object of the present invention, has the advantage of ensuring the stable locking of the structure itself in the open configuration and in the closed configuration.

Another advantage of the foldable articulated structure according to the invention consists in the fact that the locking of the structure in the closed configuration or in the open configuration occurs automatically, while the releasing only is possible by means of the manual intervention of the user.

Another advantage of the foldable articulated structure according to the invention consists in the fact that it is structurally very simple to make, it has a limited number of components and at the same time, it is particularly sturdy.

The foldable articulated structure thus conceived is susceptible to many modifications and variants, all falling within the invention; furthermore, all details can be replaced by equivalent technical elements. In practice, the materials used, as well as their sizes, can be of any type according to the technical requirements.

The invention claimed is:

1. A foldable articulated structure, particularly for supporting a seat or a bearing surface, comprising:

a first bracket which can be fastened to a wall;

a second bracket, which can be associated with a seat or a bearing surface;

a first arm, wherein a first end of said first arm is hinged to a first portion of said first bracket and a second end of said first arm is hinged to a first portion of said second bracket; and a second arm, wherein a first end of said second arm is hinged to a second portion of said first bracket and a second end of said second arm is hinged to a second portion of said second bracket;

wherein:

said foldable articulated structure is movable from a closed configuration in which said second bracket lies on a plane substantially parallel to the plane of said wall, to an open configuration in which said second bracket lies on a plane substantially orthogonal to said plane of said wall, and said second bracket includes a slider which is slidable with respect to said second bracket, said slider including first hooking means which actuate for locking said foldable articulated structure in said open configuration and second hooking means which actuate for locking said foldable articulated structure in said closed configuration, said foldable articulated structure further comprises pulling elastic means, interposed between said second bracket, and said slider, configured for holding a first hook engaged with a fastening pin in said open configuration of said foldable articulated structure and for holding a second hook engaged with a fastening pin in said closed configuration of said foldable articulated structure.

2. The foldable articulated structure according to claim 1, wherein said first hooking means comprise the first hook configured for being hooked, in said open configuration of said foldable articulated structure, to the fastening pin.

3. The foldable articulated structure according to claim 1, wherein said second hooking means comprise the second hook configured for being hooked, in said closed configuration of said foldable articulated structure, to the fastening pin.

4. The foldable articulated structure according to claim 1, wherein said first hook and said second hook are configured for being hooked, in said open configuration and in said closed configuration respectively of said foldable articulated structure, to said fastening pin.

5. The foldable articulated structure according claim 1, wherein:

axes for hinging said first bracket to said first arm and to said second arm, respectively, define a first interaxle spacing;

axes for hinging said second bracket to said first arm and to said second arm, respectively, define a second interaxle spacing;

axes for hinging said first arm to said first bracket and to said second bracket, respectively, define a third interaxle spacing; and axes for hinging said second arm to said first bracket and to said second bracket, respectively, define a fourth interaxle spacing; and in that the sum of the lengths of said first interaxle spacing and said third interaxle spacing is equal to the sum of the lengths of said second interaxle spacing and of said fourth interaxle spacing.

6. The foldable articulated structure according to claim 1, wherein said pulling elastic means include a spring having a first end fastened to a first flap integral with said slider and a second end associated with a second flap integral with said second bracket, said slider comprising a window extending in a longitudinal direction crossed by said second flap and configured for allowing the relative movement between said slider and said second bracket.

7. The foldable articulated structure according to claim 1, wherein a seat or a table is associated with said second bracket.

8. The foldable articulated structure according to claim 7, wherein said seat having a foldable portion is associated with said second bracket, said foldable articulated structure including a retaining lever which is hinged, at a first end thereof, to said first arm and, at a second end thereof, to said foldable portion of said seat, in said open configuration of said foldable articulated structure said retaining lever causing said foldable portion of said seat to be lifted from the sitting plane.

9. The foldable articulated structure according to claim 1, wherein said first bracket, said second bracket, said first arm and said second arm define a four-bar linkage whose sides, in said closed configuration, are arranged along a line, in said open configuration said four-bar linkage being configured as a right triangle.

* * * * *